United States Patent [19]

Toia

[11] 4,207,574

[45] Jun. 10, 1980

[54] PORTABLE DIPOLE ANTENNA WITH END LOADING

[76] Inventor: Michael J. Toia, 10814 Braeburn Rd., Columbia, Md. 21044

[21] Appl. No.: 940,584

[22] Filed: Sep. 8, 1978

[51] Int. Cl.[2] ..... H01Q 9/16

[52] U.S. Cl. ..... 343/752; 343/822; 343/882

[58] Field of Search ..... 343/749, 750, 752, 802, 343/822, 882

[56] References Cited

U.S. PATENT DOCUMENTS

| | | | |
|---|---|---|---|
| 2,119,692 | 6/1938 | Voigt | 343/752 |
| 2,563,243 | 8/1951 | Hills | 343/822 |

*Primary Examiner*—Eli Lieberman

*Attorney, Agent, or Firm*—Morton J. Rosenberg

[57] ABSTRACT

A portable antenna construction is provided for high frequency radio transmission and reception. A physically and electrically shortened center-fed dipole, the antenna includes a driven element assembly 62, a center insulator assembly 60, a center loading coil assembly 74, two end loading coil assemblies 70 and 72, two capacity hat assemblies 64 and 68, and a mast assembly 63, each such assembly constructed from parts allowing for easy assembly and disassembly. The antenna further includes a carrying case 78 of sufficient size to hold all disassembled parts, so that such disassembled parts can be easily transported. Center loading coil assembly 74 includes a center loading coil 76 having multiple tap points 77 for transmission line connection, thereby permitted impedance match at any frequency to which the antenna is tuned. End loading coil assemblies 70 and 72 include end loading coils 71 and 73 respectively, each having multiple tap points, permit the antenna to be specifically tuned to resonate at the desired frequency. This linearly polarized antenna, requiring no ground and is easily pivoted between horizontal and vertical modes of polarization. When utilized in the vertical mode, the lower dipole half acts as an image counterpoise so that no ground plane is necessary. Large center 76 and end loading coils 71 and 73 provide high Q for maximum radiation at the tuned frequency.

9 Claims, 10 Drawing Figures

FIG. 1
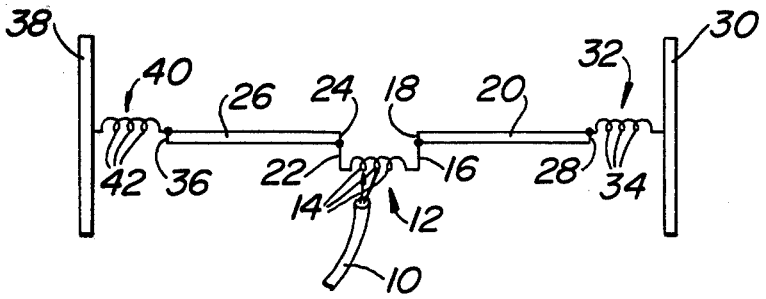
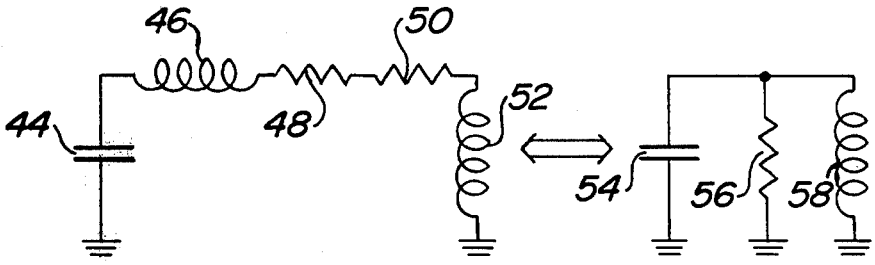
FIG. 2
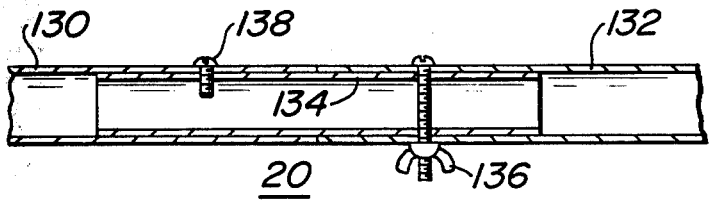
FIG. 8

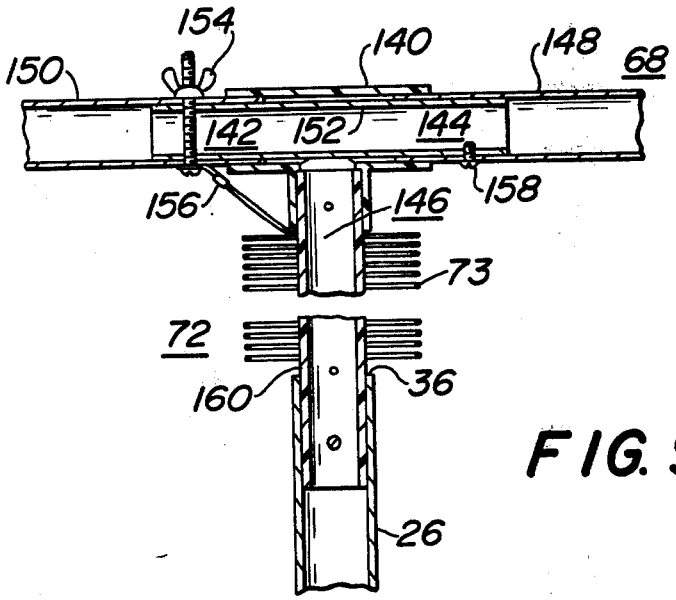
FIG. 9
FIG. 10
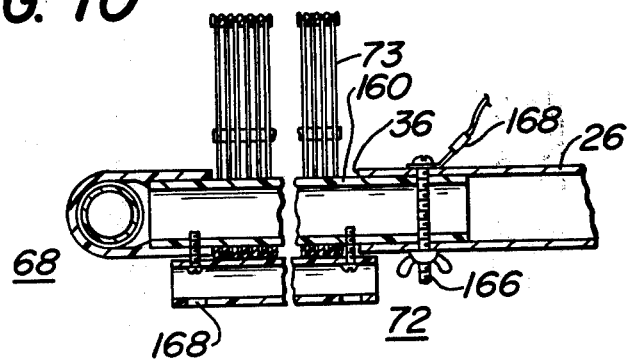

PORTABLE DIPOLE ANTENNA WITH END LOADING

BACKGROUND OF THE INVENTION

1. FIELD OF THE INVENTION

The present invention relates generally to antennas utilized for high frequency radio communication. More specifically, this invention relates to antennas utilized for transmitting and receiving radio frequency signals in the frequency range of 3 to 30 MHz. With even greater particularity, this invention relates to a portable antenna construction for such radio frequency communication providing easy assembly, disassembly, and transportation.

2. PRIOR ART

A number of vertical, dipole, and beam antennas for the 3 to 30 MHz frequency spectrum are currently available. These are generally either single band designs or multi-band designs utilizing traps to electrically shorten or lengthen the antenna for a particular band of frequencies for which the trap resonates. Many such antennas have impedance matching coils to which a transmission line is coupled and which can be tapped to provide a proper impedance match for the transmitter and transmission line. Those antennas designed to operate over a broad spectrum of frequencies are, by definition, low Q devices. They do not sharply resonate at any particular frequency, but rather, maintain a relatively flat frequency response over a broad bandwidth.

Among amateur radio operators, CBers, and shortwave operators, there is a need for an easily assembled and disassembled, relatively high Q antenna operable in the high frequency spectrum. Such an antenna should be easily tunable from frequency to frequency and maintain the ability to match a wide range of transmission feed line impedances.

Dipole antennas for high frequency radio transmission and reception are well-known in the art. The best art known to applicant is contained within the following U.S. Pat. Nos. 3,089,140; 2,875,443; 2,881,430; 3,052,883; 3,737,907.

The U.S. reference Pat. No. 3,089,140 is directed to a multi-band antenna with end mounted loading sections. Trap sections isolate various electrical antenna lengths permitting multi-band operation. However, it fails to provide the center loading coil for matching. Furthermore, it fails to show the overall contour of the antenna of the subject invention. The subject antenna is not a multi-band design and operates on one frequency in the 3-30 MHz spectrum.

The antenna of U.S. reference Pat. No. 2,875,443 is a monopole type vertical having an impedance matching loading coil coupled to ground. It fails to disclose the image antenna of the instant invention when it is operated in the vertical mode.

U.S. reference Pat. No. 2,881,430 discloses a multiband tuned antenna showing inductive coupling to a low impedance feeder.

U.S. reference Pat. No. 3,052,883 teaches an adjustable dipole antenna, however, it fails to show a center loading coil utilized for matching of the feed line.

U.S. reference Pat. No. 3,737,907 is directed to a multi-band quad and loop antenna, including opposing loading coils. However, it fails to teach matching at the center point, a critical concept to the subject invention.

SUMMARY OF THE INVENTION

It is therefore an object of the present invention to provide an antenna capable of operation in the 3 to 30 MHz range.

A further object of the present invention is to provide an antenna which is capable of being easily tuned from frequency to frequency.

Another object of the present invention is to provide a strong radiated field (high antenna current).

Still another object of the present invention is to provide an antenna having a relatively high Q at the frequency to which it is tuned.

Yet another object of the present invention is to provide an antenna construction that is easy to assemble and disassemble quickly, thereby making the antenna highly portable.

A still further object of the present invention is to provide an antenna construction including its own packing and carrying case to promote portability.

Another object of the present invention is to provide an antenna construction capable of easily being utilized for either horizontal or vertical polarization.

Still another object of the present invention is to provide an antenna that requires no ground or ground plane.

Still yet another object of the present invention is to provide an antenna requiring no attachment to a house or vehicle.

Still yet a further object of the present invention is to provide an antenna that can be used indoors or outdoors.

These and other objects of the present invention are achieved by providing a highly portable antenna construction for use in the 3 to 30 MHz frequency range.

In general design, the antenna construction is a physically and electrically short dipole (less than a half wave length long at the operating frequency) that is center fed. A driven element assembly includes first and second dipole members, each having a driven and non-driven end. A center insulator assembly mechanically couples the first and second dipole members while electrically insulating them from one another. The center insulator assembly also provides a convenient point for attachment of a mast assembly. Furthermore, the center insulator assembly provides attachment of the antenna to the mast assembly so that the antenna can be pivoted from horizontal to vertical polarization.

A center loading coil assembly is mechanically fixed to the center insulating assembly and electrically couples the first and second dipole members. Convenient tap points are provided for coupling of a transmission line.

Capacity hat assemblies in close proximity to the non-driven ends of the first and second dipole members provide for capacitive loading and a favorable current distribution at the operating frequency. These capacity hats are coupled to the non-driven ends of the first and second dipole members through end loading coil assemblies, also having convenient tap points like the center loading coil assembly.

Tuning to the desired frequency is accomplished by moving the tap point on the three loading coil assemblies and impedance matching to the transmission line is provided by moving the transmission feed line to the appropriate tap point on the center loading coil assembly.

Each dipole member is approximately six feet long and the capacity hats are approximately six feet long and positioned perpendicular to the non-driven end of each dipole member, so as to form a broad letter "H". The antenna is easily tuned to specific frequencies in the 3–30 MHz frequency spectrum, and the center loading coil assembly provides impedance matching for the popular coaxial cables or for 300–600 ohm balanced flat cables or open wire transmission line.

BRIEF DESCRIPTION OF THE DRAWINGS

A more complete understanding of the invention and a fuller appreciation of the many attendant advantages thereof will be derived by referenced to the following detailed description, with the appended claims, when considered in conjunction with the accompanying drawings, wherein:

FIG. 1 is a pictorial/schematic diagram of the general antenna design, according to the present invention;

FIG. 2 is an electrical schematic of the antenna according to the present invention;

FIG. 8 is a cross-sectional view of one of the driven element assemblies, showing both of its dipole members;

FIG. 9 is a top cross-sectional view of the capacity hat and end loading coil assemblies;

FIG. 10 is a side cross-sectional view of an end loading coil assembly.

DESCRIPTION OF THE PREFERRED EMBODIMENTS

Figure 3:
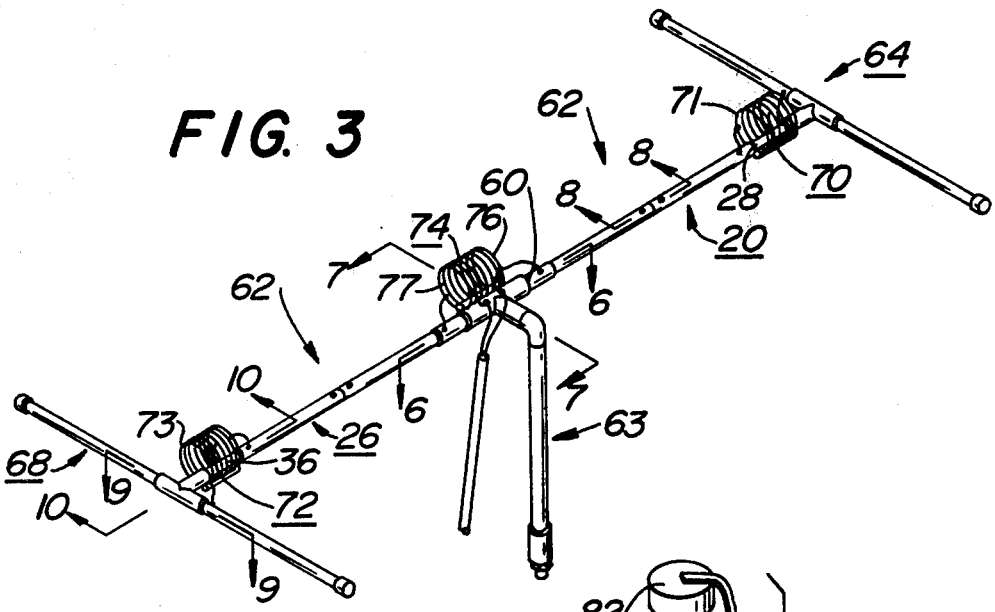
FIG. 3 is a pictorial view of the antenna construction according to the present invention.

Referring now to the drawings, wherein like reference characters designate identical or corresponding parts throughout the figures and referring first specifically to FIG. 1, which schematically and pictorially details the general electrical design of the antenna according to the present invention, the antenna is essentially a half wave length dipole that is both electrically and physically shortened. A transmission line 10 is shown coupled to an inductive matching element 12 at the physical center of the antenna. Transmission line 10 is coupled at two of the tap-off points 14 of inductive matching element 12, useful for establishing impedance match at the frequency to which the antenna is tuned. Electrical end 16 of inductive matching element 12 is coupled to the driven end 18 of a first dipole member 20. Electrical end 22 of inductive matching element 12 is coupled to the driven end 24 of a second dipole member 26. The non-driven end 28 of first dipole member 20 is coupled to a first capacitive loading element 30 by a first inductive loading coil 32 having various tap-off points 34. The non-driven end 36 of second dipole member 26 is coupled to a second capacitive loading element 38 by a second inductive loading coil 40 having various tap-off points 42.

Radio frequency current is maintained high at the non-driven ends 28 and 36 of dipole members 20 and 26 respectively, by the use of identical inductive loading coils 32 and 40 working respectively into first capacitive loading element 30 and second capacitive loading element 38. Radiation principally occurs from first and second dipole members 20 and 26. First and second capacitive loading elements 30 and 38 add little to the external field, but provide essential tuning. Inductive matching element 12 allows impedance matching for transmission line 10 coupled to its various tap points 14. Resonance at the desired operating frequency is established principally by first and second inductive loading coils 32 and 40.

Referring now to FIG. 2, the electrical equivalent circuit of the general electrical design shown in FIG. 1 and of the antenna according to the present invention is depicted schematically. Capacitor 44 represents the capacitance of one of capacitive loading elements 30 or 38. Inductor 46 series coupled to capacitor 44 represents the inductance of one of inductive loading coils 32 or 40. Resistor 48 series coupled to inductor 46 represents resistive losses and resistor 50 series coupled to resistor 48 represents radiation resistance. Inductor 52 coupled from resistor 50 to ground represents the inductance of matching element 12.

When inductive loading coils 32 and 40 are adjusted to tune the antenna slightly higher in frequency than the intended resonant frequency (too little inductance) the combination of capacitor 44 and inductor 46 representing capacitive loading element 30 or 38 and inductive loading coil 32 or 40, produces a net capacitive reactance represented by a capacitor 54. For short, high Q dipole antennas of this type, both the loss resistance 48 and radiation resistance 50 are relatively low. The sum of these resistances represented by resistors 48 and 50 in series with capacitor 54, representing the net capacity of the capacitive loading element and inductive loading coil, is approximately equal to a high resistance represented by resistor 56 in parallel with capacitor 54.

Inductive matching element 12 is used to bring capacitor 54 into resonance at the desired frequency of operation. Then, by tapping across inductive matching element 12 at its various tap-off points 14, any resistive feed impedance up to the value of resistor 56 can be established.

Referring now to FIG. 3, which is a pictorial view of the assembled antenna construction according to the present invention, the antenna includes several main assemblies. A center insulator assembly 60 provides a convenient coupling point for a driven element assembly 62 and a means for the antenna to be supported by a mast assembly 63 coupled thereto. Driven element assembly 62 includes first dipole member 20 and second dipole member 26 (shown pictorially on FIG. 1). Capacity hat assembly 64 coupled to first dipole member 20 provides the first capacitive loading element 30 shown pictorially in FIG. 1. A capacity hat assembly 68 identical to assembly 64 and coupled to second dipole member 26 provides the second capacitive loading element 38 shown in FIG. 1. An end loading coil assembly 70 including an end loading coil 71 coupling the non-driven end 28 of first dipole member 20 to capacity hat assembly 64 provides the first inductive loading coil 32 of FIG. 1. A second end loading coil assembly 72 including an end loading coil 72 coupled to non-driven end 36 of second dipole member 26 to capacity hat assembly 68 provides the second inductive loading coil 40 called for in FIG. 1. A center loading coil assembly 74 including center loading coil 76 provides the necessary inductive matching element 12 called for in FIG. 1.

As will be further explained, each of these assemblies are constructed from short lengths of aluminum tubing, small plastic elements and small coils.

Figure 4:
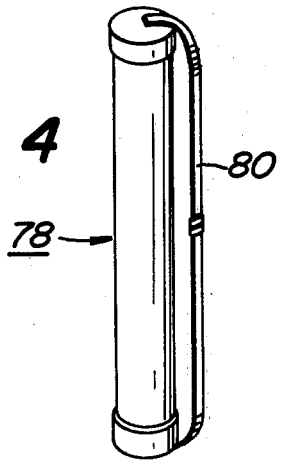
FIG. 4 is a pictorial view of the carrying case.

Referring to FIG. 4, a carrying case 78 with strap 80 is provided having sufficient inside diameter to include all disassembled parts of the various antenna assemblies.

Figure 5:
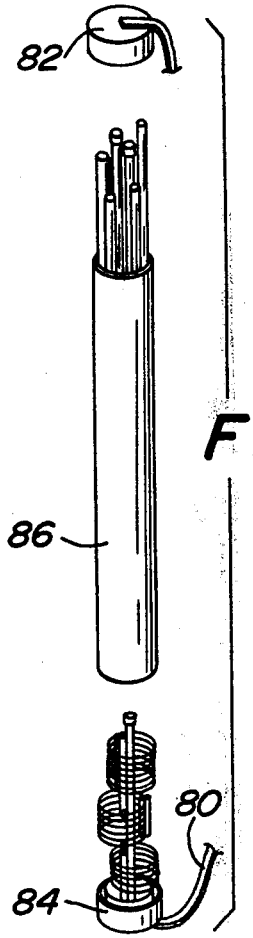
FIG. 5 is an exploded view of the carrying case packed with the various antenna component parts.

Referring now to FIG. 5, which is an exploded view of the carrying case, including the disassembled antenna parts, case 78 includes a top member 82 and bottom member 84 which are both force fit and removable from tube 86. As shown, when disassembled, the various metal tube members and coil elements are easily insertable within tube 86 as shown in the figure. After insertion of all parts, top and bottom members 82 and 84 can be force fit about tube 86 and the user can easily transport the entire antenna construction by grasping strap 80.

Figure 6:
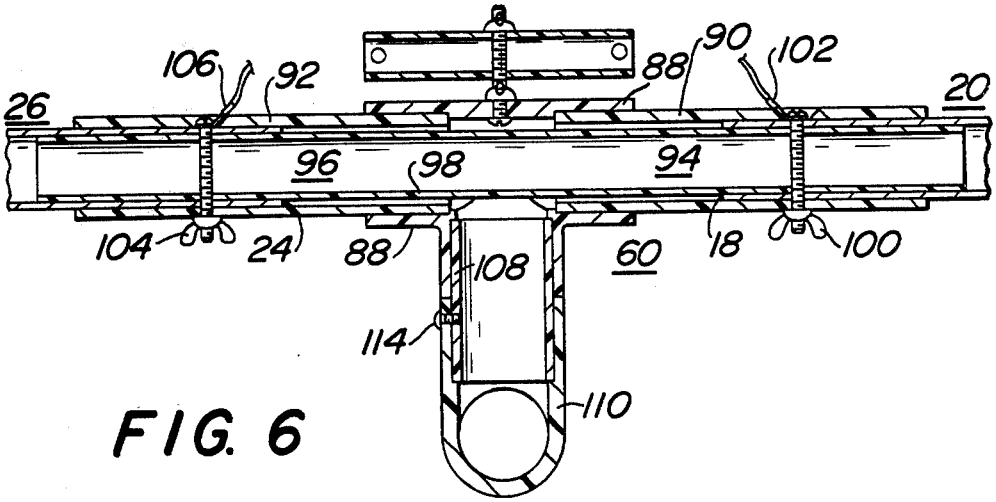
FIG. 6 is a top cross-sectional view detailing the center insulator assembly and its connection with the driven element assembly.

Referring now to FIG. 6 which is a top cross-sectional view, detailing center insulator assembly 60, the heart of the center insulator assembly is a T-shaped center insulator element 88 constructed from plastic. Both legs and base of T-shaped center insulator element 88 are hollow to accomodate the insertion of tubular members. Plastic pipe members 90 and 92 are force fit into legs 94 and 96 of center insulator element 88. Metal pipe members 90 and 92 are electrically separated by T-shaped element 88 even though held rigidly in place by their force fit within the T-shaped element. Driven end 18 of first dipole member 20 is inserted within plastic tube member 90 and non-driven end 24 of second dipole member 26 is inserted within the plastic tube member 92, such that each dipole member is not in contact electrically but is mechanically coupled with one another. A center insulator plastic pipe element 98 is inserted within the non-driven ends 18 and 24 of dipole member 20 and 26 so as to hold both dipole members rigidly and colinear in common attachment to center insulator assembly 60. Wing nut bolt combination 100 rigidly secures plastic pipe member 90, plastic pipe element 98 and first dipole member 20 while further providing a convenient point for electrical connection 102. Wing nut bolt combination 104 rigidly secures plastic pipe member 92, plastic pipe member 98 and second dipole member 26 while providing a convenient electrical contact point 106 for connection to second dipole member 26. A plastic tube member 108 inserted within the hollowed base of center insulator T-shaped element 88, provides a convenient attachment point for an elbow 110 of mast assembly 62. A bolt 114 fastens metal pipe member 108 with elbow 110.

Figure 7:
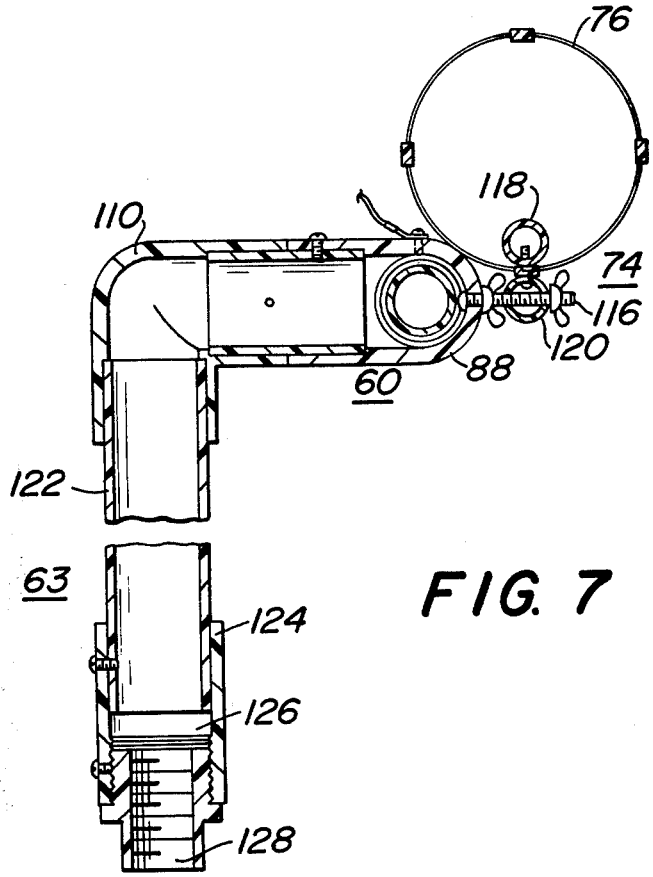
FIG. 7 is a side cross-sectional view of the center insulator assembly, and center loading coil assembly and further includes the mast assembly.

Referring now to FIG. 7, there is shown a side cross-sectional view of center insulator assembly 60, center loading coil assembly 74, and mast assembly 63. Center loading coil assembly 74 is attached through center insulator element 88 via wing nut bolt combination 116. Essentially, coil 76 is supported between two insulating tubular members 118 and 120 such that the coil is supported away from center insulator assembly 60. The two outer tap points of coil 76 are coupled one each to electrical contact points 102 and 106. Mast assembly 63 includes a plastic mast 122 inserted within elbow 110 at its upper end and inserted within a coupler 124 at its lower end. A reducer 126 and pipe plug 128 provide convenient connection point to a portable tripod or other such device.

Referring now to FIG. 8, which is a cross-sectional view of first dipole member 20, the first dipole member includes inner and outer aluminum tube members 130 and 132, respectively. Aluminum tube members 130 and 132 are of the same diameter and abut one another. They are held rigid and colinear by an aluminum sleeve member 134 inserted within both. Wing nut bolt combination 136 secures sleeve 134 with outer metal tube member 132 and bolt 138 secures sleeve member 134 with inner metal tube member 130.

Referring now to FIG. 9, there is shown a top cross-sectional view of capacity hat assembly 68 and end loading coil assembly 72, including end loading coil 73. The heart of capacity hat assembly 68 is a plastic T-shaped member 140 having legs 142 and 144 and base 146. Two aluminum tube members 148 and 150 are inserted into legs 144 and 142, respectively of plastic member 140. An aluminum tubular member 152 inserted through both tubular members 148 and 150 provides mechanical rigidity and electrical conductivity. A wing nut bolt combination 154 secures metal tube member 152 to tube member 150 while providing a convenient electrical connection point 156. A bolt 158 secures metal tube member 152 to metal tube member 148. End loading assembly 72 includes a plastic tubular member 160 inserted into non-driven end 36 of second dipole member 26 and into base 146 of T-shaped member 140, providing mechanical coupling between dipole member 26 and plastic member 140. An end loading coil 73 having multiple windings and tap points is mechanically supported around plastic tubular member 160 and has one end electrical lead coupled to electrical connection point 156.

Referring now to FIG. 10, there is shown a side cross-sectional view of capacity hat assembly 68 and end loading coil assembly 72. Coil 73 is shown supported on an insulating strip 164 and plastic tubular element 160 is shown inserted within the non-driven end 36 of dipole member 26. Wing nut bolt combination 166 mechanically fastens plastic tube member 160 with dipole member 26 while providing a convenient electrical connection point 168 for the remaining electrical lead of coil 73. In this manner, coil 73 electrically couples capacity hat assembly 68 to dipole member 26 without being short-circuited.

Therefore it is apparent that there has been provided a physically and electrically short dipole primarily for short-wave high frequency radio communications, useful for both transmitting and receiving. The antenna includes a driven element assembly supported by a center insulator and mast assembly, two capacity hat assemblies, two end loading coil assemblies and a center loading coil assembly. It spans approximately twelve feet in overall length, utilizing two six-foot dipole members, each made from two sections of aluminum tubing, still less than an electrical half wave length at thirty MHz. This antenna is capacitively loaded at both ends to provide a favorable current distribution for proper field radiation. Capacity hat assembies approximately six feet in overall length and made from two sections of aluminum tubing are inductively connected to the non-driven ends of each dipole member. Utilizing six foot length capacity hats, end loading coils commercially available from Barker and Williams Company, having ten turns per inch, will allow the tuning into resonance of the antenna from three to thirty MHz by tapping these coils at appropriate points. The use of a similar coil in the center loading coil assembly provides impedance matching for most commercially available transmission lines. By providing both center matching and end loading in combination with capacity hats, the antenna maintains a relatively high Q at any frequency to which it is tuned. Because of its small size, the antenna is highly portable and can be easily set-up and placed on a tripod or other means for support. The antenna proves highly effective even when only seven and one-half feet off the ground. The antenna is easily pivoted at the elbow, so that it can be used for horizontal or vertical polarization. When used in the vertical polarization mode, no ground plane is provided as the lower dipole member serves as an image antenna for the upper dipole member, acting as a vertical.

The use of eight metal tube members and insulating T-shaped members all having interlocking ends, provides easy assembly and disassembly, so that the antenna is highly portable. It can be set-up or disassembled in approximately ten minutes and packed into its own carrying case.

Obviously, other embodiments and modifications of the present invention will readily come to those of ordinary skill in the art, having the benefit of the teachings presented in the foregoing Description and Drawings. It is therefore to be understood that this invention is not to be limited thereto, and that said modifications and embodiments are intended to be included within the scope of the appended claims.

What is claimed is:

1. An antenna comprising:

a driven antenna element for radiating radio frequency energy including first and second dipole members, each of said dipole members having driven and non-driven ends;

a continuous inductive matching element coupling said driven ends of said first and second dipole members to one another and through which said driven element is fed with radio frequency energy to be radiated;

a tubular first capacitive loading element;

a first inductive loading coil element coupling said first capacitive loading element to said non-driven end of said first dipole member;

a tubular second capacitive loading element, said first and second tubular capacitive loading elements being rotatively displaceable for predetermined angular polarization;

a second inductive loading coil element coupling said second capacitive loading element to said non-driven end of said second dipole member, wherein the combination of said dipole members with said inductive matching element, said capacitive loading elements, and said inductive loading elements resonates at the frequency of said radio frequency energy to be radiated and presents a predetermined impedance at said inductive matching element.

2. The antenna of claim 1 wherein said first and second capacitive loading elements are capacity hats.

3. The antenna of claim 1 wherein said inductive matching element is a coil having multiple tap points for the connection thereto of a transmission feed line.

4. A portable antenna construction comprising:

a driven element assembly including first and second dipole members, each having a driven and non-driven end;

a center insulator assembly mechanically coupling said driven ends of said first and second dipole members while electrically insulating said members from one another;

a center loading continuous coil assembly mechanically fixed to said center insulator assembly and having two electrical ends, one such end coupled to each dipole member;

first and second end loading coil assemblies coupled to said non-driven ends of said first and second dipole members, respectively;

first and second capacity hat assemblies coupled to said first and second end loading coil assemblies, respectively, said first and second capacity hat assemblies including first and second tubular capacitive loading elements; and, a mast assembly pivotally coupled to center insulator assembly for supporting said entire antenna construction.

5. The antenna construction of claim 4, wherein each of said dipole members of said driven element assembly comprises:

an inner metal pipe member;

an outer metal pipe member;

a driven element metal tube member having an outside diameter slightly smaller than the inside diameter of said inner and outer metal pipe members, one end of said driven element metal pipe member being inserted into said inner metal pipe member and the other end of said metal pipe member being inserted into said outer metal pipe member, such that the inner and outer pipe members are in contact with one another and are held in contact relation to one anothr by said driven element metal pipe member; and, means for fastening both inner and outer pipe members to said driven element metal tube member.

6. The antenna construction of claim 4, wherein said center insulator assembly comprises:

center insulator element having essentially a "T" shape, wherein each leg of said "T" accomodates a tubular member;

outer plastic center insulator pipe member force-fit into both legs of said "T" shaped center insulator element that are colinear, said outer center insulator plastic pipe members having an outside diameter slightly larger than the outside diameter of said inner metal pipe members of said driven element dipole members for accomodating said dipole members insertable therein;

a center insulator plastic pipe member inserted within said center insulator element, said outer plastic center insulator pipe member, and said dipole inner metal pipe members, said center insulator plastic pipe member aiding in providing mechanical rigidity among said center insulator elements, said outer plastic center pipe insulator members, and said dipole inner pipe members while preventing electrical contact between said dipole inner metal pipe members;

means for fastening said outer center insulator plastic pipe members with their respective dipole inner metal pipe member and said center insulator plastic pipe member; and, means for electrically coupling to each of said dipole inner metal pipe members.

7. The antenna construction of claim 4, wherein said center coil assembly comprises:

a central coil insulating support member rigidly fastened to a center insulator "T" shaped element of said center insulator assembly; and, an induction coil having two electrical leads supported on and rigidly fastened to said central coil insulating support member, wherein said electrical leads are coupled one each to said electric coupling means for said dipole inner metal pipe members.

8. The antenna construction of claim 4, wherein said capacity hat assemblies comprise:

a substantially "T" shaped central insulating member; and, first and second capacity hat metal tube members, one each insertable into each leg of said "T" shaped insulating member.

9. The antenna construction of claim 4, wherein each of said end loading coil assemblies comprise:

a loading coil insulating tube member having a diameter such that it is insertable into both said non-driven end of said driven element assembly and said base of a central "T" shaped insulating member of said capacity hat assembly; and, an end loading coil rigidly coupled to said loading coil insulating tube member and electrically coupling said driven element assembly to said capacity hat assembly.

* * * * *